US009316425B2

(12) United States Patent
Mitchell

(10) Patent No.: US 9,316,425 B2
(45) Date of Patent: Apr. 19, 2016

(54) ICE MAKING ASSEMBLY FOR A REFRIGERATOR APPLIANCE

(71) Applicant: General Electric Company, Schenectady, NY (US)

(72) Inventor: Alan Joseph Mitchell, Louisville, KY (US)

(73) Assignee: General Electric Company, Schenectady, NY (US)

( * ) Notice: Subject to any disclaimer, the term of this patent is extended or adjusted under 35 U.S.C. 154(b) by 227 days.

(21) Appl. No.: 14/080,835

(22) Filed: Nov. 15, 2013

(65) Prior Publication Data

US 2015/0135757 A1 May 21, 2015

(51) Int. Cl.
*F25C 1/22* (2006.01)
*F25C 1/00* (2006.01)

(52) U.S. Cl.
CPC ..... *F25C 1/00* (2013.01)

(58) Field of Classification Search
CPC ..... F25C 1/04; F25C 1/225; F25C 5/005; F25C 1/00
USPC ..... 62/340, 344, 66
See application file for complete search history.

(56) References Cited

U.S. PATENT DOCUMENTS

| | | | | |
|---|---|---|---|---|
| 2,717,501 | A | 9/1955 | Andersson | |
| 2,869,060 | A * | 1/1959 | Chace | F25C 1/04 318/117 |
| 7,032,391 | B2 | 4/2006 | Tremblay et al. | |
| 7,216,491 | B2 * | 5/2007 | Cole | F25C 1/04 62/188 |
| 2006/0086135 | A1 * | 4/2006 | Wu | F25C 1/04 62/351 |
| 2006/0207282 | A1 * | 9/2006 | Visin | F25C 1/24 62/351 |

* cited by examiner

*Primary Examiner* — Melvin Jones
(74) *Attorney, Agent, or Firm* — Dority & Manning, P.A.

(57) ABSTRACT

An ice making assembly for a refrigerator appliance is provided. The ice making assembly includes a mold body and an ejector. The ejector has a shaft with a central axis that is offset from an axis of rotation of the ejector. The ejector also has a plurality of tines for sweeping through mold volumes of the mold body. Each tine has an arcuate bottom surface.

19 Claims, 9 Drawing Sheets

ICE MAKING ASSEMBLY FOR A REFRIGERATOR APPLIANCE

FIELD OF THE INVENTION

The present subject matter relates generally to ice making assemblies for appliances, such as refrigerator appliances.

BACKGROUND OF THE INVENTION

Certain refrigerator appliances include an ice maker for producing ice. The ice maker can receive liquid water, and such liquid water can freeze within the ice maker to form ice. In particular, certain ice makers include a mold body that defines a plurality of cavities. The plurality of cavities can be filled with liquid water, and such liquid water can freeze within the plurality of cavities to form ice cubes.

During freezing, the ice cubes can adhere or stick to the mold body, and removing the ice cubes from the mold body can be difficult. Ice makers can include various mechanisms for assisting removal of ice cubes from the mold body. Certain ice makers include an ejector with a plurality of generally straight or linear tines. During rotation of the ejector, the tines sweep through the cavities of the mold body to scoop the ice cubes out of the cavities. Such ejectors generally work well with relatively large crescent shaped ice cubes, such as crescent shaped ice cubes having a length of two and one half inches, a width of about thirteen sixteenths of an inch and a height of about one inch. However, such ejectors can have difficulty removing relatively small crescent shaped ice cubes, such as crescent shaped ice cubes having a length of one and one half inches, a width of about one inch and a height of about half an inch.

During the ice formation process, a "volcano" defect can form on the ice cube due to expansion of liquid water within a partially frozen cube. In particular, expanding liquid water within the partially formed ice cube can form a hole at the ice cube's weakest point, generally a top center portion of the ice cube. Liquid water from within the partially formed ice cube can flow out of the hole and freeze to form the volcano defect. The size of the volcano defect varies with cube size and shape as well as a rate of freezing. For example, the volcano defect can be more pronounced with relatively small and/or thin ice cubes. During harvesting, the volcano defect can impact the ejector and interfere with rotation of the ejector and/or removal of ice cubes from the mold body.

Accordingly, an ice maker with features for assisting with harvesting of ice cubes would be useful. In particular, an ice maker with features for assisting with harvesting of relatively small crescent shaped ice cubes or ice cubes with volcano defects would be useful.

BRIEF DESCRIPTION OF THE INVENTION

The present subject matter provides an ice making assembly for a refrigerator appliance. The ice making assembly includes a mold body and an ejector. The ejector has a shaft with a central axis that is offset from an axis of rotation of the ejector. The ejector also has a plurality of tines for sweeping through mold volumes of the mold body. Each tine has an arcuate bottom surface. Additional aspects and advantages of the invention will be set forth in part in the following description, or may be apparent from the description, or may be learned through practice of the invention.

In a first exemplary embodiment, an ice making assembly for a refrigerator appliance is provided. The ice making assembly includes a mold body that defines a plurality of mold volumes for forming ice cubes therein. An ejector has a pair of supports and a shaft. The shaft of the ejector extends between the pair of supports such that a central axis of the shaft is offset from an axis of rotation of the pair of supports. The ejector also has a plurality of tines mounted to the shaft of the ejector. Each tine of the plurality of tines is positioned at a respective one of the plurality of mold volumes of the mold body. Each tine of the plurality of tines has an arcuate bottom surface.

In a second exemplary embodiment, an ice making assembly for an appliance is provided. The ice making assembly defines an axial direction, a radial direction and a circumferential direction. The ice making assembly includes a mold body that defines a plurality of mold volumes for forming ice cubes therein. The mold volumes of the plurality of mold volumes are distributed along the axial direction. An ejector has a pair of supports and a shaft. The shaft of the ejector extends between the pair of supports along the axial direction such that a central axis of the shaft is offset from an axis of rotation of the ejector along the radial direction. The ejector is rotatable about the axis of rotation. The ejector also has a plurality of tines that are mounted to the shaft of the ejector. Each tine of the plurality of tines rotates into a respective one of the plurality of mold volumes of the mold body during rotation of the ejector about the axis of rotation. Each tine of the plurality of tines has an arcuate bottom surface that extends along the circumferential direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
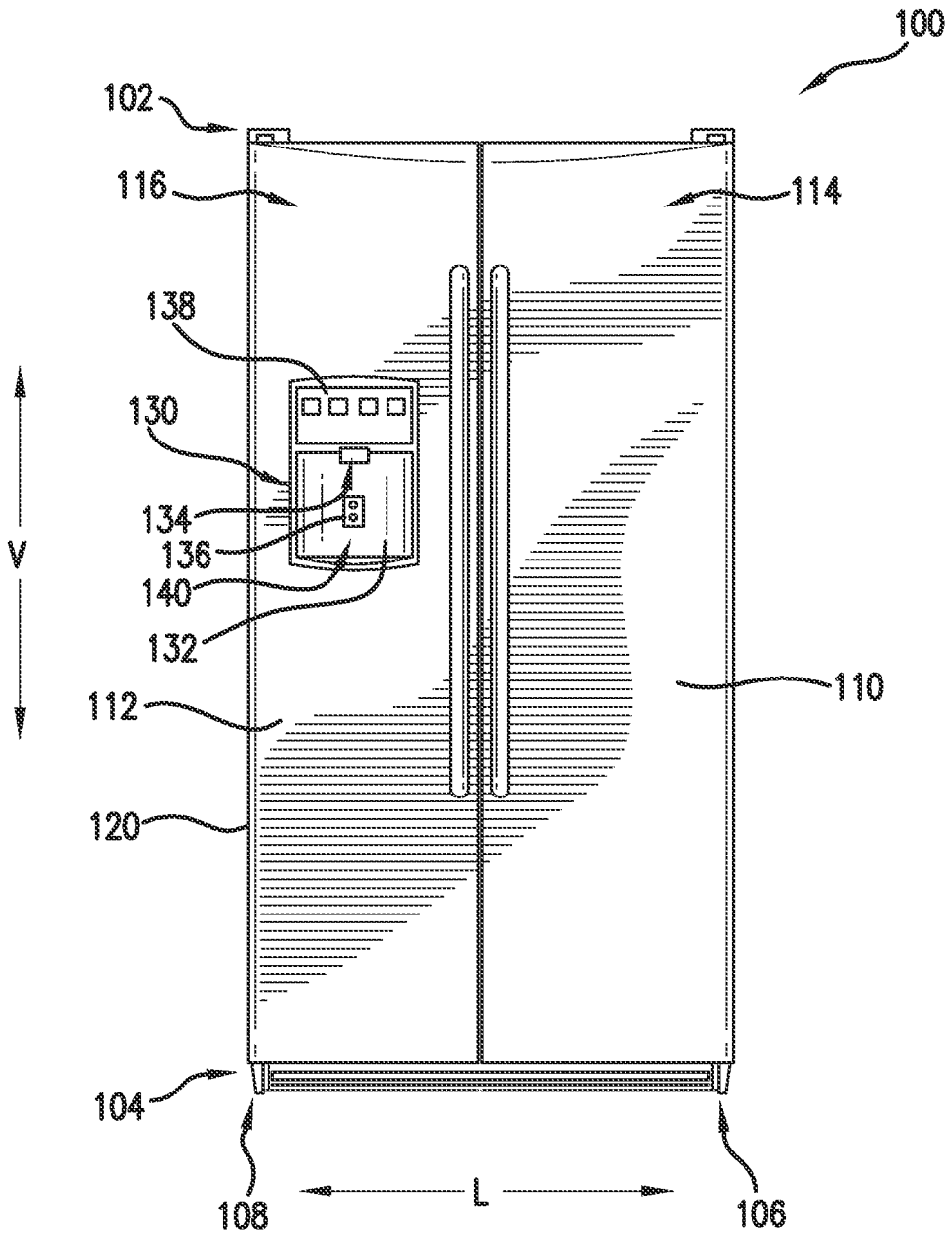
FIG. 1 provides a front, elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
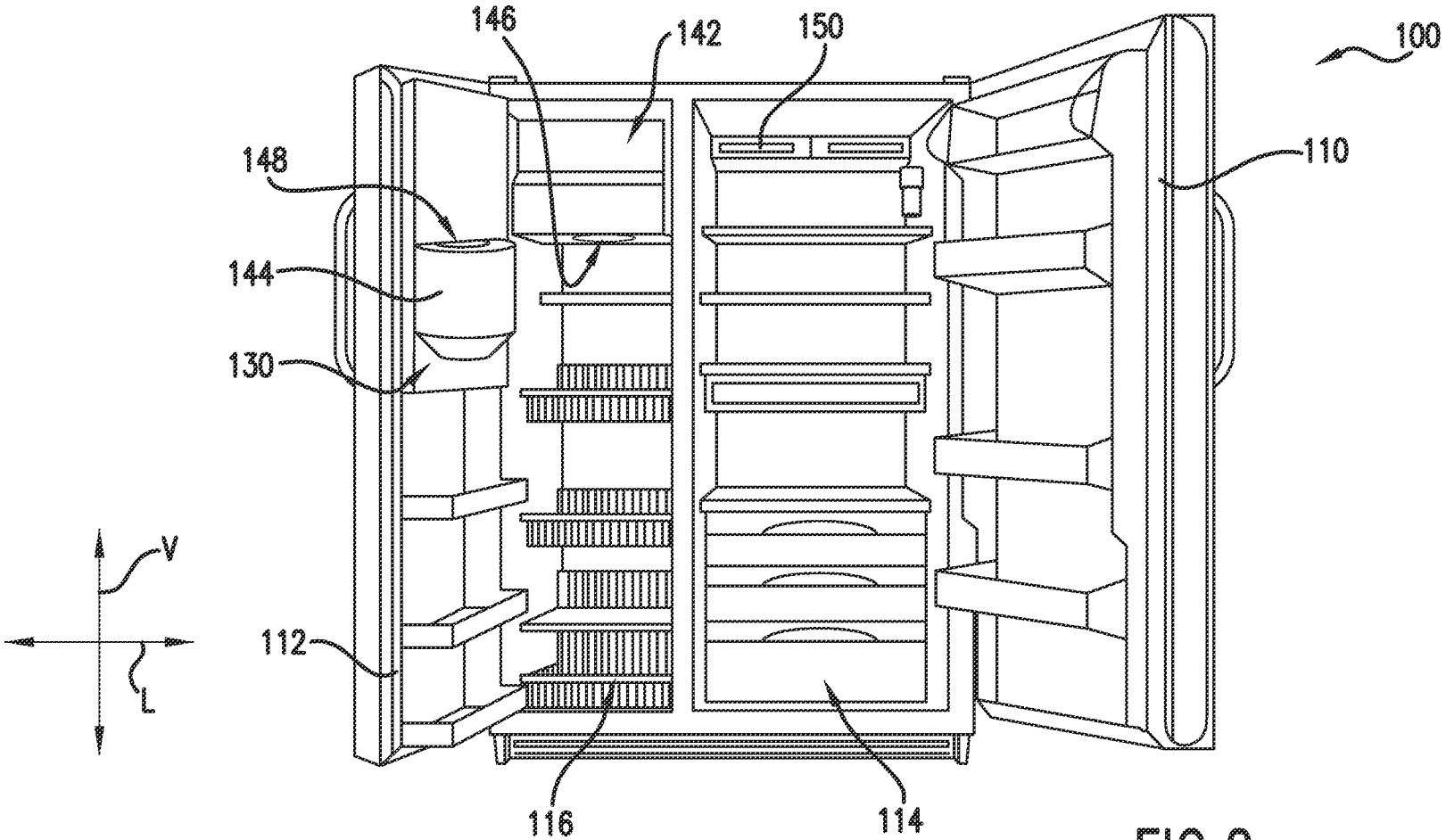
FIG. 2 provides a front, elevation view of the exemplary refrigerator appliance of FIG. 1 with a refrigerator door and a freezer door of the exemplary refrigerator appliance shown in an open position to reveal a fresh food chamber and a freezer chamber of the exemplary refrigerator appliance.

FIG. 1 provides a front, elevation view of a refrigerator appliance 100 according to an exemplary embodiment of the present subject matter. FIG. 2 provides a front, elevation view of refrigerator appliance 100 with a refrigerator door 110 and a freezer door 112 of refrigerator appliance 100 shown in an open position to reveal a fresh food chamber 114 and a freezer chamber 116 of refrigerator appliance 100. Refrigerator appliance 100 defines a vertical direction V and a lateral direction L. The vertical direction V and lateral direction L are perpendicular to each other. Refrigerator appliance 100 extends between an upper portion 102 and a lower portion 104 along the vertical direction V. Refrigerator appliance 100 also extends between a first side portion 106 and a second side portion 108, e.g., along the lateral direction L.

Refrigerator appliance 100 includes a cabinet 120 that defines chilled chambers for receipt of food items for storage. In particular, refrigerator appliance 100 defines fresh food chamber 122 at first side portion 106 of refrigerator appliance 100 and a freezer chamber 124 arranged next to fresh food chamber 122 at second side portion 108 of refrigerator appliance 100. As such, refrigerator appliance 100 is generally referred to as a side-by-side style refrigerator appliance. However, using the teachings disclosed herein, one of skill in the art will understand that the present subject matter may be used with other types of refrigerator appliances (e.g., bottom mount or top mount style) or a freezer appliance as well. Consequently, the description set forth herein is for illustrative purposes only and is not intended to limit the present subject matter to any particular chilled chamber arrangement.

Refrigerator door 110 is rotatably hinged to an edge of cabinet 120 for accessing fresh food chamber 114. Similarly, freezer door 112 is rotatably hinged to an edge of cabinet 120 for accessing freezer chamber 116. Refrigerator door 110 and freezer door 112 can rotate between an open position (shown in FIG. 2) and a closed position (shown in FIG. 1) in order to permit selective access to fresh food chamber 114 and freezer chamber 116, respectively.

Refrigerator appliance 100 also includes a dispensing assembly 130 for dispensing water and/or ice. Dispensing assembly 130 includes a dispenser 132 positioned on or mounted to an exterior portion of refrigerator appliance 100, e.g., on freezer door 112. Dispenser 132 includes a discharging outlet 134 for accessing ice and water. Any suitable actuator may be used to operate dispenser 132. For example, dispenser 132 can include a paddle or button for operating dispenser. A sensor 136, such as an ultrasonic sensor, is mounted below discharging outlet 134 for operating dispenser 132, e.g., during an auto-fill process of refrigerator appliance 100. A user interface panel 138 is provided for controlling the mode of operation. For example, user interface panel 138 includes a water dispensing button (not labeled) and an ice-dispensing button (not labeled) for selecting a desired mode of operation such as crushed or non-crushed ice.

Discharging outlet 134 and sensor 136 are an external part of dispenser 130 and are mounted in a dispenser recess 140 defined in an outside surface of freezer door 112. Dispenser recess 140 is positioned at a predetermined elevation convenient for a user to access ice or water and enabling the user to access ice without the need to bend-over and without the need to access freezer chamber 116. In the exemplary embodiment, dispenser recess 140 is positioned at a level that approximates the chest level of a user.

Turning now to FIG. 2, certain components of dispensing assembly 130 are illustrated. Dispensing assembly 130 includes a housing 142 mounted within freezer chamber 116. Housing 142 is constructed and arranged to facilitate production and storage of ice. More particularly, housing 142 contains an ice maker (not shown) for creating ice and feeding the same to a container 144 that is mounted on freezer door 112. As illustrated in FIG. 2, container 144 is placed at a vertical position on freezer door 112 that will allow for the receipt of ice from a discharge opening 146 into an entrance 148 of container 144. As freezer door 112 is closed or opened, container 144 is moved in and out of position under housing 142.

Operation of the refrigerator appliance 100 can be regulated by a controller 150 that is operatively coupled to user interface panel 138 and/or sensor 136. User interface panel 138 provides selections for user manipulation of the operation of refrigerator appliance 100 such as e.g., selections between whole or crushed ice, chilled water, and/or other options as well. In response to user manipulation of the user interface panel 138, controller 150 operates various components of the refrigerator appliance 100. Controller 150 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 150 may be positioned in a variety of locations throughout refrigerator appliance 100. In the illustrated embodiment, controller 150 is located at upper portion 102 or refrigerator appliance 100 within fresh food chamber 114. However, in alternative exemplary embodiments, controller 150 may be located within the control panel area of freezer door 112. Input/output ("I/O") signals may be routed between controller 150 and various operational components of refrigerator appliance 100. For example, user interface panel 138 may be in communication with controller 150 via one or more signal lines or shared communication busses.

Figure 3:
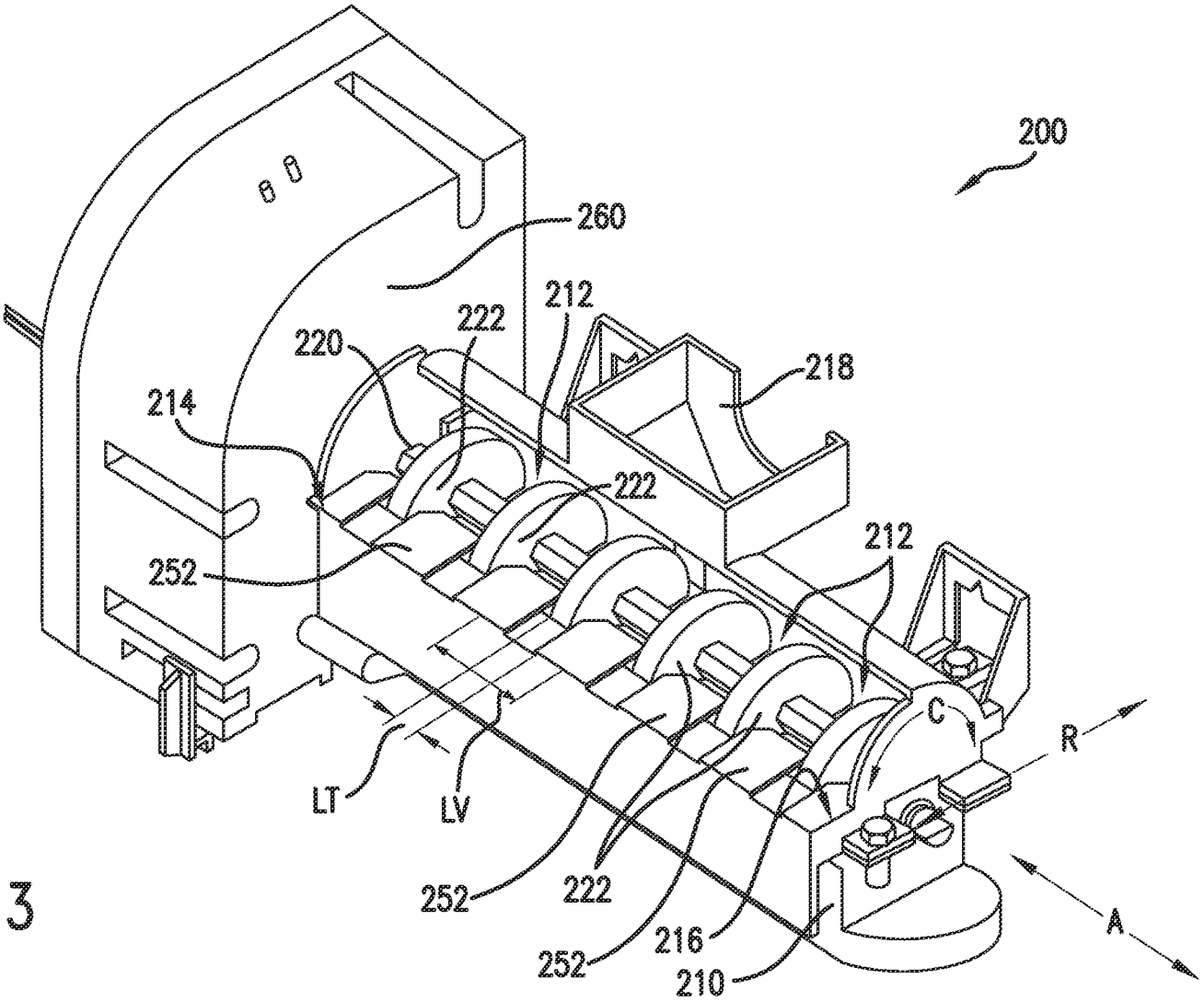
FIG. 3 provides a perspective view of an ice making assembly according to an exemplary embodiment of the present subject matter.

FIG. 3 provides a perspective view of an ice making assembly 200 according to an exemplary embodiment of the present subject matter. Ice making assembly 200 is configured for production of ice cubes as discussed in greater detail below. Ice making assembly 200 can be used within any suitable refrigerator appliance, such as refrigerator appliance 100 (FIG. 1). As an example, ice making assembly 200 may be positioned within housing 142 of refrigerator appliance 100.

Figure 5:
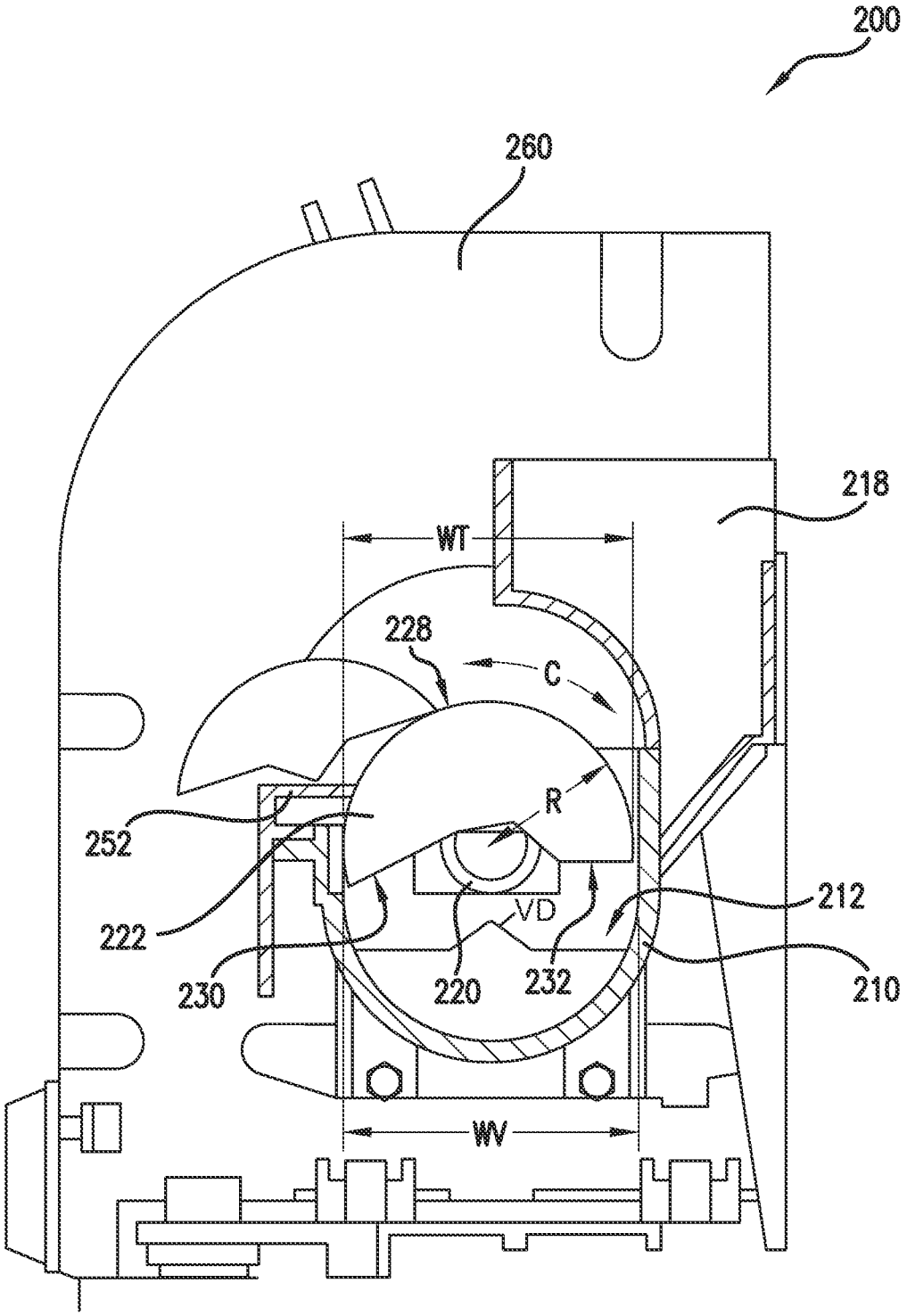
FIGS. 5, 6, 7, 8 and 9 provide partial, section views of the exemplary ice making assembly of FIG. 3 shown in various stages of a harvesting operation.
Figure 6:
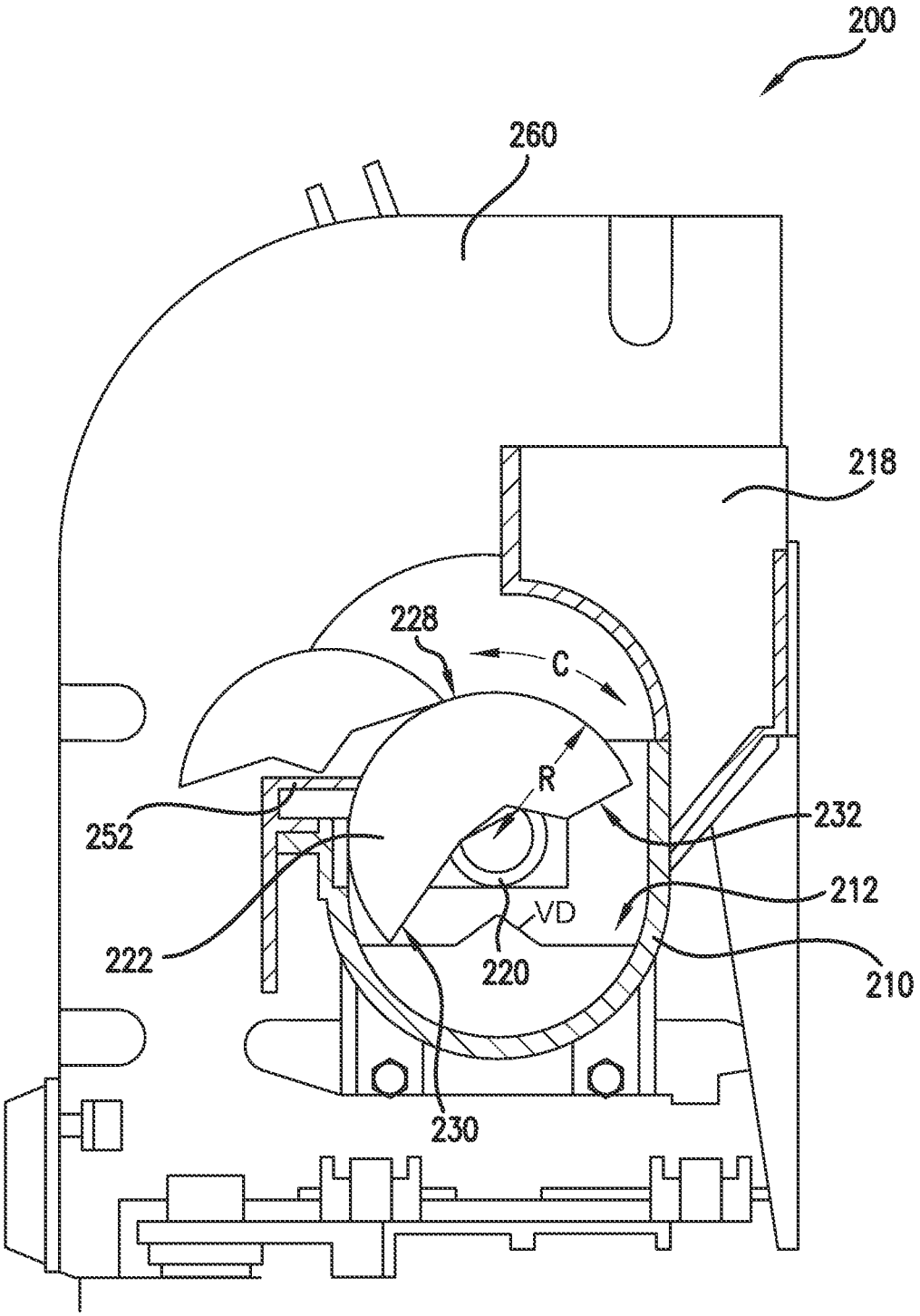
Figure 7:
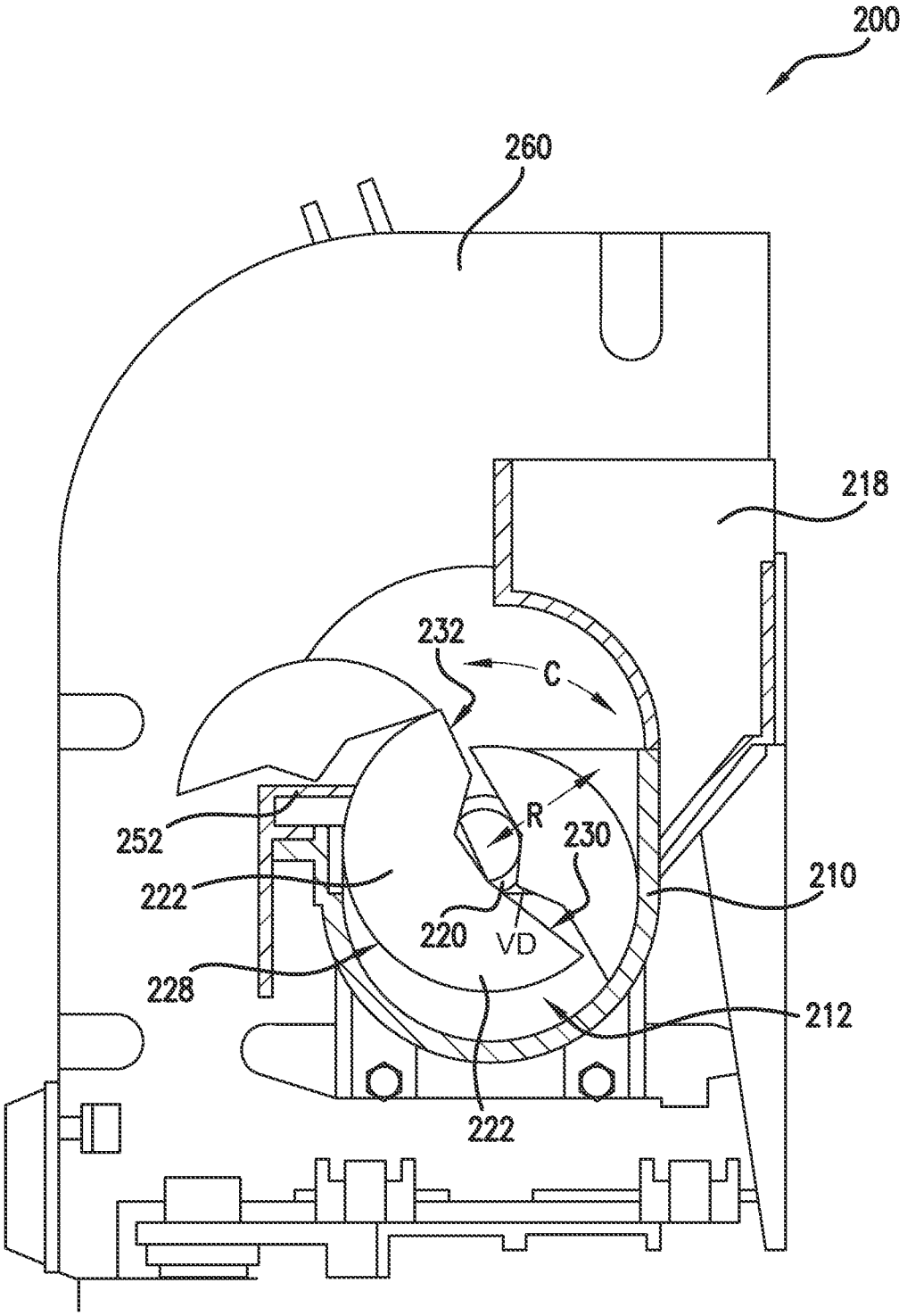
Figure 8:
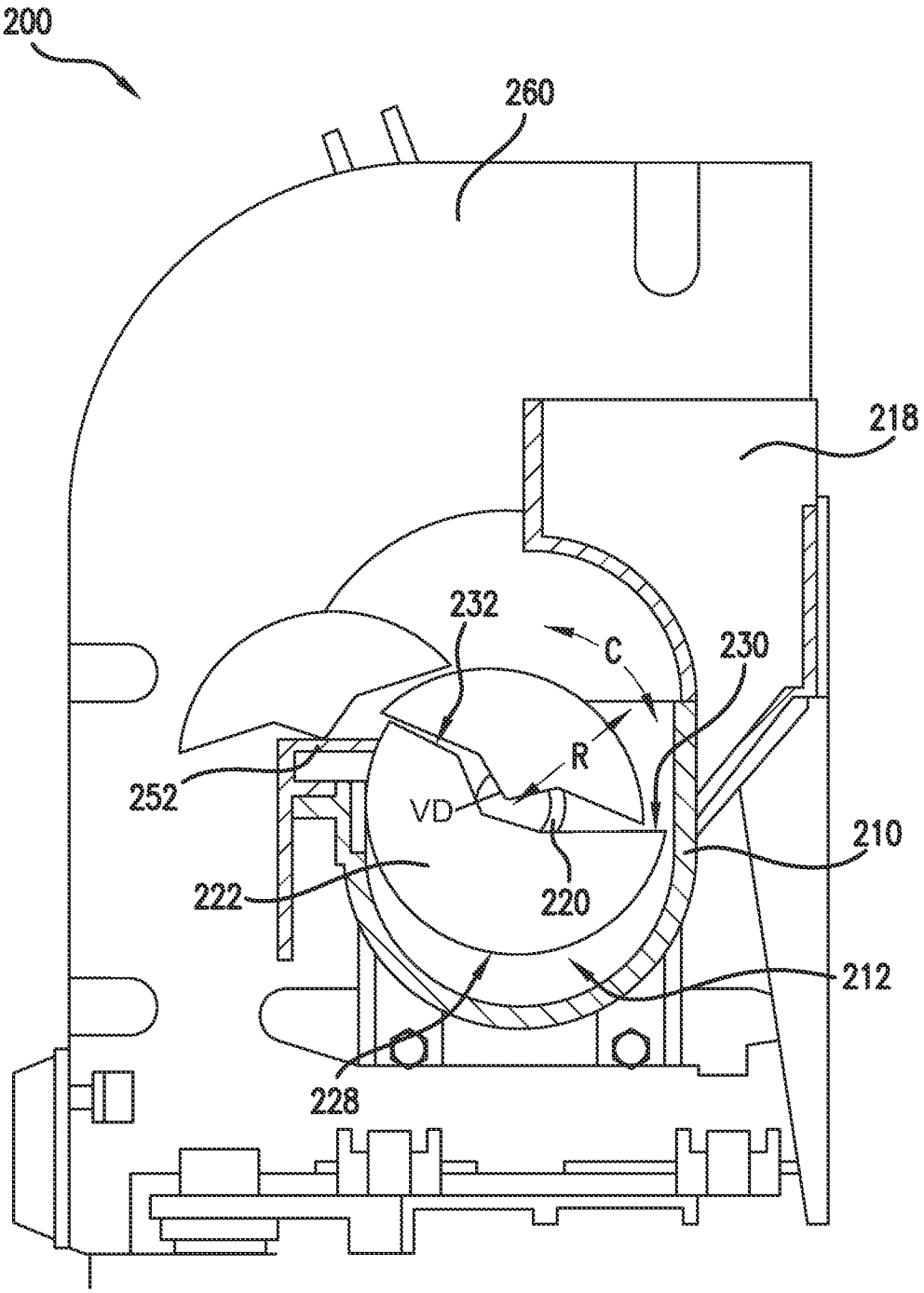
Figure 9:
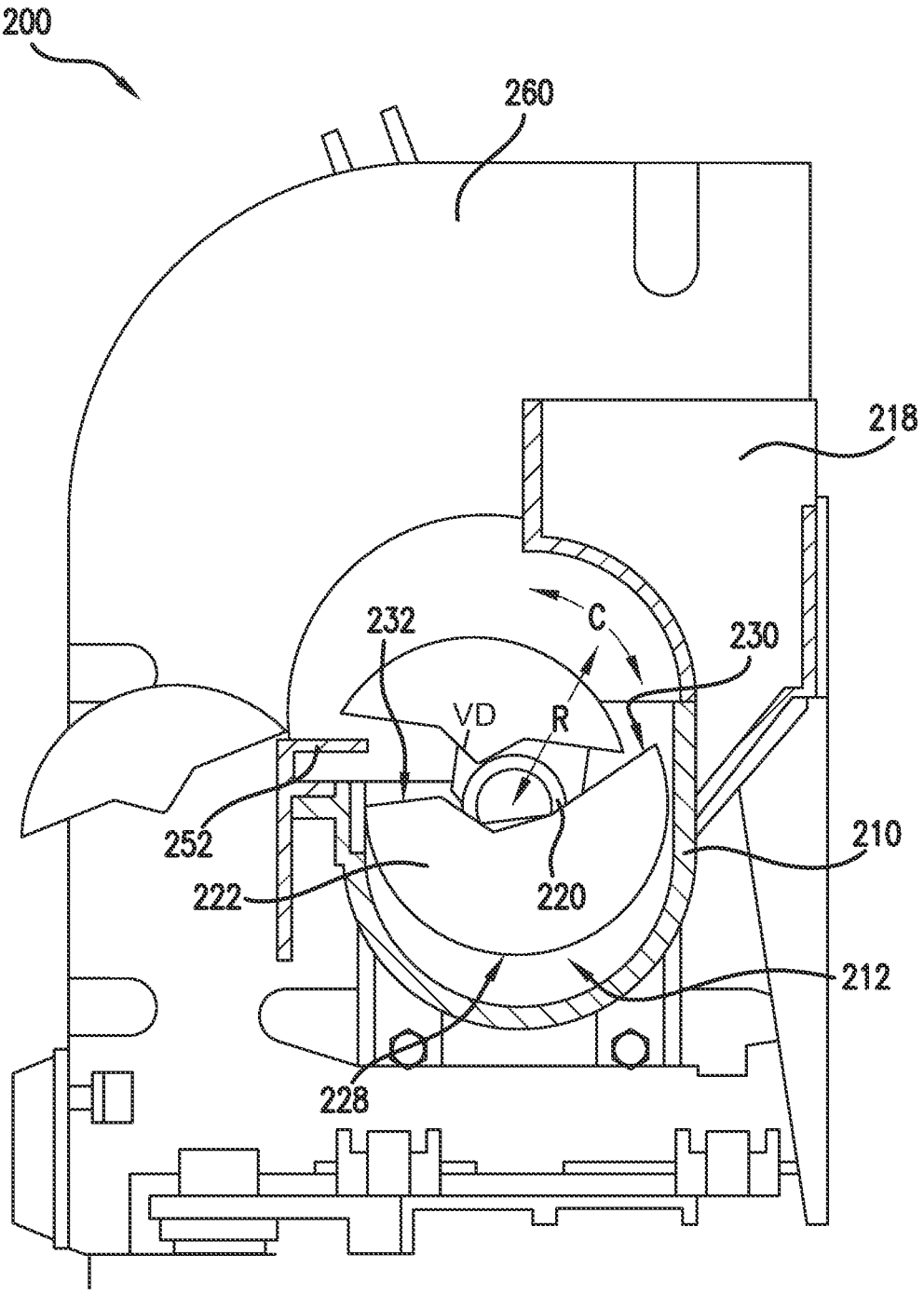

As may be seen in FIG. 3, ice making assembly 200 defines an axial direction A, a circumferential direction C and a radial direction R. Ice making assembly 200 includes a mold body 210 that extends between a first end portion 214 and a second end portion 216, e.g., along the axial direction A. Mold body 210 defines a plurality of mold volumes 212 (FIG. 5) for receipt of liquid water for freezing. In particular, ice making assembly 200 includes a water cup 218 that can receive liquid water, e.g., from a water connection to plumbing within a residence or business housing refrigerator appliance 100, and direct such liquid water into mold body 210, e.g., into mold volumes 212 of mold body 210. Mold volumes 212 are spaced apart from one another or distributed, e.g., along the axial direction A between first end portion 214 and second end portion 216 of mold body 210.

Within mold volumes 212 of mold body 210, liquid water received from water cup 218 can freeze to from ice cubes. Mold volumes 212 can have any suitable size. For example, mold volumes 212 may be sized for forming ice cubes having a length of about one inch, a width of about one and a half inches and a height of about half an inch therein. As will be understood by those skilled in the art, ice cubes within mold volumes 212 can adhere or stick to mold body 210 and, e.g., hinder removal of such ice cubes from mold body 210. Ice making assembly 200 includes features for assisting removal of ice cubes from mold body 210. In particular, ice making assembly 200 includes an ejector 220 with a plurality of tines 222. Ejector 220 is rotatable with a motor 260 of ice making assembly 200. During rotation of ejector 220, tines 222 sweep through mold volumes 212 to harvest ice cubes from mold volumes 212. Ejector 220 includes features for hindering jamming of ejector 220 during harvesting of ice cubes as discussed in greater detail below.

Ice making assembly 200 also includes a plurality of stripper tines 252. Stripper tines 252 are positioned at, e.g., and mounted to, a top portion of mold body 210. Each stripper tine of stripper tines 252 is positioned, e.g., and extend along the axial direction A, between a respective pair of tines 222. Stripper tines 252 are fixed during rotation of ejector 220 and assist with removing ice cubes from ejector 220 and with hindering or preventing ice cubes from falling back into mold body 210 during ice cube harvesting.

Figure 4:
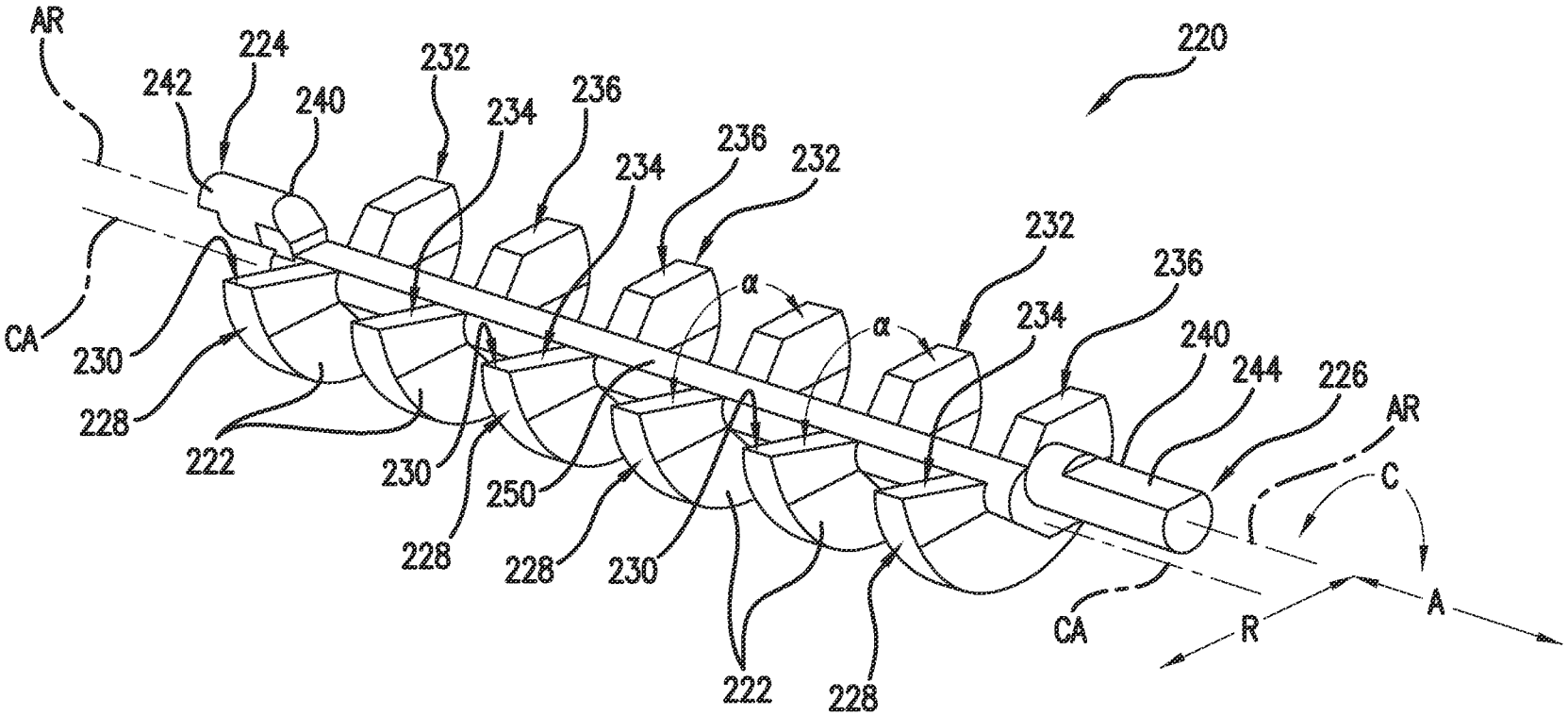
FIG. 4 provides a perspective view of an ejector of the exemplary ice making assembly of FIG. 3.

FIG. 4 provides a perspective view of ejector 220. As may be seen in FIG. 4, ejector 220 has a pair of supports 240 and a shaft 250. Shaft 250 extends between supports 240, e.g., along the axial direction A. Supports 240 include a first support 242 and a second support 244. First and second supports 242 and 244 are spaced apart from each other, e.g., along the axial direction A. In particular, ejector 220 extends between a first end portion 224 and a second end portion 226, e.g., along the axial direction A. First support 242 is positioned at or adjacent first end portion 224 of ejector 220. Second support 244 is positioned at or adjacent second end portion 226 of ejector 220. First support 242 may also be positioned at or adjacent first end portion 214 of mold body 210 and engage motor 260 to permit rotation of ejector 220.

Shaft 250 extends, e.g., linearly, between first and second supports 242 and 244, e.g., along the axial direction A. Shaft 250 defines a central axis CA. Central axis CA may be substantially parallel to the axial direction A. Ejector 220 also defines an axis of rotation AR. Axis of rotation AR may be substantially parallel to the axial direction A. Ejector 220 is rotatable about the axis of rotation AR with motor 260. Central axis CA of shaft 250 is offset from axis of rotation AR of ejector 220, e.g., along the radial direction R. Central axis CA of shaft 250 can be offset from axis of rotation AR of ejector 220, e.g., along the radial direction R, by any suitable distance. For example, central axis CA of shaft 250 may be offset from axis of rotation AR of ejector 220, e.g., along the radial direction R, by more than about one eight of an inch and less than about an inch. As another example, central axis CA of shaft 250 may be offset from axis of rotation AR of ejector 220, e.g., along the radial direction R, by about one quarter of an inch.

Tines 222 are mounted to shaft 250. In particular, tines 222 are spaced apart from each other along the axial direction A on shaft 250. Each tine of tines 222 has an arcuate bottom surface 228, e.g., that extends along the circumferential direction C. Arcuate bottom surface 228 extends between a first end portion 230 and a second end portion 232, e.g., along the circumferential direction C. Thus, first and second end portions 230 and 232 of arcuate bottom surface 228 are spaced apart from each other, e.g., along the circumferential direction C or about the central axis CA of shaft 250. First and second end portions 230 and 232 of arcuate bottom surface 228 can be spaced apart by any suitable amount, e.g., along the circumferential direction C or about the central axis CA of shaft 250. For example, first and second end portions 230 and 232 of arcuate bottom surface 228 may be spaced apart by more than about ninety degrees and less than about two hundred and seventy degrees along the circumferential direction C or about the central axis CA of shaft 250. As another example, first and second end portions 230 and 232 of arcuate bottom surface 228 may be spaced apart by more than about one hundred and eighty degrees and less than about two hundred and twenty degrees along the circumferential direction C or about the central axis CA of shaft 250.

Each tine of tines 222 also has a first upper surface 234 and a second upper surface 236. First upper surface 234 is positioned at or adjacent first end portion 230 of arcuate bottom surface 228. Second upper surface 236 is positioned at or adjacent second end portion 232 of arcuate bottom surface 228. First and second upper surfaces 234 and 236 define an angle $\alpha$ therebetween, e.g., in a plane that is perpendicular to the axial direction A. Angle $\alpha$ can be any suitable angle. For example, angle $\alpha$ may be greater than about one hundred and ten degrees and less than about two hundred degrees.

Turning back to FIG. 3, each tine of tines 222 has a length LT, e.g., along the axial direction A. In addition, each mold volume of mold volumes 212 has a length LV, e.g., along the axial direction A. The length LT of tines 222 can be any suitable length. Similarly, the length LV of mold volumes 212 can be any suitable length. For example, the length LT of tines 222 may be less than the length LV of mold volumes 212. As another example, the length LT of tines 222 may be less than about half of the length LV of mold volumes 212.

FIGS. 5, 6, 7, 8 and 9 provide partial, section views of ice making assembly 200 shown in various stages of a harvesting operation. As may be seen in FIG. 5, each tine of tines 222 has a width WT, e.g., along the radial direction R. In addition, each mold volume of mold volumes 212 has a width WV, e.g., along the radial direction R. The width WT of tines 222 can be any suitable width. Similarly, the width WV of mold volumes 212 can be any suitable width. For example, the width WT of tines 222 may be less than the width WV of mold volumes 212. As another example, the width WT of tines 222 may be about equal to the width WV of mold volumes 212.

Tines 222 can have any suitable shape. For example, as may be seen in FIGS. 5-9, each tine of tines 222 may define an augmented semicircular shape, e.g., in a plane that is perpendicular to the axial direction A. As used herein, the term "augmented semicircular shape" corresponds to the shape of tines 222 shown in FIG. 5 that includes an arcuate bottom surface and at least two angled upper surfaces.

As may be seen in FIGS. 5-9, ice making assembly 200 includes features for preventing or limiting jamming of ejector 220, e.g., during rotation of ejector 220. In particular, as may be seen in FIGS. 5-9, an ice cube within mold volume 212 can have a volcano defect VD. By offsetting central axis CA of shaft 250 from axis of rotation AR of ejector 220, the volcano defect VD is not forced against tines 222 or shaft 250 and does not jam ejector 220 during removal of the ice cube and rotation of ejector 220 about the axis of rotation AR.

In addition, ice making assembly 200 also includes features for preventing or hindering harvested ice cubes from falling back into mold body 210. In particular, turning to FIG. 5, an ice cube can become stuck on stripper tines 252. As may be seen in FIGS. 6 and 7, arcuate bottom surface 228 supports the stuck ice cube and hinders or prevents the ice cube from falling back into mold body 210, e.g., during formation of an additional ice cube within mold body 210. As may be seen in FIGS. 8 and 9, a subsequently harvested ice cube can dislodge or displace the stuck ice cube during continued rotation of ejector 220. To further assist with hindering or preventing ice cubes from falling back into mold body 210, a gap between stripper tines 252 and shaft 250, e.g., along the radial direction R, can have a maximum size of about half an inch during rotation of ejector 220 about the axis of rotation AR.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly for a refrigerator appliance, comprising:

a mold body defining a plurality of mold volumes for forming ice cubes therein;

an ejector having a pair of supports and a shaft, the shaft of the ejector extending between the pair of supports such that a central axis of the shaft is offset from an axis of rotation of the pair of supports, the ejector also having a plurality of tines mounted to the shaft of the ejector, each tine of the plurality of tines positioned at a respective one of the plurality of mold volumes of the mold body, each tine of the plurality of tines having an arcuate bottom surface; and a plurality of stripper tines positioned at a top portion of the mold body, each stripper tine of the plurality of stripper tines positioned between a respective pair of the plurality of tines of the ejector.

2. The ice making assembly of claim 1, wherein the arcuate bottom surface of each tine of the plurality of tines extends between a first end portion and a second end portion, the first and second end portions of each tine of the plurality of tines spaced apart from each other by more than about ninety degrees and less than about two hundred and seventy degrees in a plane that is perpendicular to the central axis of the shaft.

3. The ice making assembly of claim 1, wherein the central axis of the shaft is offset from the axis of rotation of the pair of supports by about one quarter of an inch.

4. The ice making assembly of claim 1, wherein the arcuate bottom surface of each tine of the plurality of tines extends between a first end portion and a second end portion, each tine of the plurality of tines having a first upper surface positioned at the first end portion of the arcuate bottom surface and a second upper surface positioned at the second end portion of the arcuate bottom surface, the first and second upper surfaces defining an angle $\alpha$ therebetween in a plane that is perpendicular to the central axis of the shaft, the angle $\alpha$ being greater than about one hundred and ten degrees and less than about two hundred degrees.

5. The ice making assembly of claim 1, wherein a width of each tine of the plurality of tines is about equal to a width of the respective one of the plurality of mold volumes of the mold body.

6. The ice making assembly of claim 1, wherein the plurality of stripper tines and the central axis of the shaft define a gap therebetween in a plane that is perpendicular to the central axis of the shaft, the gap having a maximum size of about half an inch.

7. The ice making assembly of claim 1, wherein each tine of the plurality of tines defines an augmented semicircular shape in a plane that is perpendicular to the central axis of the shaft.

8. The ice making assembly of claim 1, wherein each mold volume of the plurality of mold volumes is sized for forming an ice cube having a length of about one inch, a width of about one and a half inches and a height of about half an inch.

9. The ice making assembly of claim 1, wherein each tine of the plurality of tines has a length and each mold volume of the plurality of mold volumes has a length, the length of each tine of the plurality of tines being less than about half of the length of each mold volume of the plurality of mold volumes.

10. An ice making assembly for an appliance, the ice making assembly defining an axial direction, a radial direction and a circumferential direction, the ice making assembly comprising:

a mold body defining a plurality of mold volumes for forming ice cubes therein, the mold volumes of the plurality of mold volumes distributed along the axial direction;

an ejector having a pair of supports and a shaft, the shaft of the ejector extending between the pair of supports along the axial direction such that a central axis of the shaft is offset from an axis of rotation of the ejector along the radial direction, the ejector rotatable about the axis of rotation, the ejector also having a plurality of tines mounted to the shaft of the ejector, each tine of the plurality of tines rotating into a respective one of the plurality of mold volumes of the mold body during rotation of the ejector about the axis of rotation, each tine of the plurality of tines having an arcuate bottom surface that extends along the circumferential direction.

11. The ice making assembly of claim 10, wherein the arcuate bottom surface of each tine of the plurality of tines extends between a first end portion and a second end portion along the circumferential direction, the first and second end portions of each tine of the plurality of tines spaced apart from each other by more than about ninety degrees and less than about two hundred and seventy degrees along the circumferential direction.

12. The ice making assembly of claim 10, wherein the central axis of the shaft is offset from the axis of rotation of the ejector by about one quarter of an inch along the radial direction.

13. The ice making assembly of claim 10, wherein the arcuate bottom surface of each tine of the plurality of tines extends between a first end portion and a second end portion along the circumferential direction, each tine of the plurality of tines having a first upper surface positioned at the first end portion of the arcuate bottom surface and a second upper surface positioned at the second end portion of the arcuate bottom surface, the first and second upper surfaces defining an angle $\alpha$ therebetween in a plane that is perpendicular to the axial direction, the angle $\alpha$ being greater than about one hundred and ten degrees and less than about two hundred degrees.

14. The ice making assembly of claim 10, wherein a width of each tine of the plurality of tines along the radial direction is about equal to a width of the respective one of the plurality of mold volumes of the mold body along the radial direction.

15. The ice making assembly of claim 10, further comprising a plurality of stripper tines positioned at a top portion of the mold body, each stripper tine of the plurality of stripper tines positioned between a respective pair of the plurality of tines of the ejector along the axial direction.

16. The ice making assembly of claim 15, wherein the plurality of stripper tines and the central axis of the shaft define a gap therebetween along the radial direction, the gap having a maximum size of about half an inch during rotation of the ejector about the axis of rotation.

17. The ice making assembly of claim 10, wherein each tine of the plurality of tines defines an augmented semicircular shape in a plane that is perpendicular to the axial direction.

18. The ice making assembly of claim 10, wherein each mold volume of the plurality of mold volumes is sized for forming an ice cube having a length of about one inch, a width of about one and a half inches and a height of about half an inch.

19. The ice making assembly of claim 10, wherein each tine of the plurality of tines has a length along the axial direction and each mold volume of the plurality of mold volumes has a length along the axial direction, the length of each tine of the plurality of tines being less than about half of the length of each mold volume of the plurality of mold volumes.

* * * * *